US010593171B2

(12) United States Patent
Harrison et al.

(10) Patent No.: US 10,593,171 B2
(45) Date of Patent: Mar. 17, 2020

(54) ANTI-LIGATURE ALARM

(71) Applicant: Intastop Limited, Doncaster (GB)

(72) Inventors: Richard John Harrison, Worksop (GB); Daniel Lee Szlamp, Doncaster (GB)

(73) Assignee: Intastop Limited, Doncaster (GB)

( * ) Notice: Subject to any disclaimer, the term of this patent is extended or adjusted under 35 U.S.C. 154(b) by 0 days.

(21) Appl. No.: 16/252,828

(22) Filed: Jan. 21, 2019

(65) Prior Publication Data

US 2019/0266862 A1 Aug. 29, 2019

(30) Foreign Application Priority Data

Feb. 24, 2018 (GB) ..... 1803031.2

(51) Int. Cl.

| | |
|---|---|
| ***G08B 29/00*** | (2006.01) |
| ***G08B 13/08*** | (2006.01) |
| ***G08B 21/02*** | (2006.01) |
| ***G08B 29/14*** | (2006.01) |
| ***E06B 7/28*** | (2006.01) |
| ***G08B 25/01*** | (2006.01) |
| ***G08B 21/04*** | (2006.01) |

(52) U.S. Cl.

CPC ..... *G08B 13/08* (2013.01); *E06B 7/28* (2013.01); *G08B 21/02* (2013.01); *G08B 21/0461* (2013.01); *G08B 25/01* (2013.01); *G08B 29/14* (2013.01)

(58) Field of Classification Search

CPC .... G08B 13/08; G08B 21/02; G08B 21/0461; G08B 25/01; G08B 29/14; E06B 7/28

USPC ..... 340/514

See application file for complete search history.

(56) References Cited

U.S. PATENT DOCUMENTS

| | | | | |
|---|---|---|---|---|
| 7,466,237 | B1 | 12/2008 | Cook | |
| 7,999,690 | B1 * | 8/2011 | Shilts | E05D 7/009 200/85 R |
| RE42,991 | E | 12/2011 | Cook | |
| RE44,039 | E | 3/2013 | Cook | |
| 8,803,689 | B2 | 8/2014 | Berger | |
| 2010/0194563 | A1 * | 8/2010 | Berner | E05D 11/00 340/545.1 |
| 2011/0016971 | A1 * | 1/2011 | Yulkowski | G08B 21/043 73/493 |

(Continued)

FOREIGN PATENT DOCUMENTS

| | | |
|---|---|---|
| WO | 2010/075567 A2 | 7/2010 |
| WO | 2010/079337 A2 | 7/2010 |

*Primary Examiner* — Naomi J Small

(74) *Attorney, Agent, or Firm* — Cooper Legal Group, LLC

(57) ABSTRACT

An anti-ligature alarm device, comprises a sensing unit and a control unit. The sensing unit detects an external force when the external force is applied to the sensing unit and also transmits a signal indicating an alarm condition. The control unit comprises a receiver which receives the signal on detection of the external force. The sensing unit also includes a power source and a controller and the sensing unit and control unit are wirelessly paired to each other. The sensing unit also comprises a boost module which maintains a voltage input from the power source to the controller. The control unit is wirelessly networked to an alert device and the anti-ligature alarm device further includes a pairing device which is used to pair the sensing unit and the control unit.

19 Claims, 12 Drawing Sheets

(56) References Cited

U.S. PATENT DOCUMENTS

| | | | | |
|---|---|---|---|---|
| 2011/0225886 | A1 | 9/2011 | Block et al. | |
| 2014/0144084 | A1* | 5/2014 | Keller | E06B 5/10 49/148 |
| 2017/0172415 | A1* | 6/2017 | Wik | H04W 4/80 |

* cited by examiner

ANTI-LIGATURE ALARM

CROSS REFERENCE TO RELATED APPLICATIONS

This application claims priority from United Kingdom Patent Application No. 18 03 031.2, filed 24 Feb. 2018, the entire disclosure of which is incorporated herein by reference in its entirety.

BACKGROUND OF THE INVENTION

The present invention relates to an anti-ligature alarm device, a method of detecting an alarm condition in an anti-ligature alarm device and a method of installing an anti-ligature alarm device.

In mental institutions and prisons, patients and/or prisoners are known to utilize the surrounding equipment or infrastructure in order to self-harm or commit suicide. A particular problem is that patients create ligature points on doors or doorways to enable suicide, by means of a makeshift rope hung over a door, for example.

Door top alarm systems mounted to the top of a door are typically configured to provide an alarm on application of a force to the top of the door so as to alert staff members to the possibility that a patient is attempting suicide in this way.

Current systems typically include a wired connection which extends from the top of the door and through the hinge of the door in order to transmit an alarm when necessary to a unit which staff can respond to. The wired system presents the problem that operatives do not always fit the wire adequately and it can suffer damage during installation. In this way, the wired system can fail and be difficult to set up. Further, because these types of devices are integral to the door hinge itself, continuous movement of the door hinge can also lead to premature damage or fatigue and failure of the system.

Wireless systems have been proposed as an alternative. However, implementing a wireless version of a door top alarm is problematic due to the complexity of the electronic circuitry required. Thus, a wireless system which is able to function effectively in anti-ligature environments is required.

BRIEF SUMMARY OF THE INVENTION

According to an aspect of the present invention, there is provided an anti-ligature alarm device, comprising: a sensing unit configured to detect an external force when said external force is applied to said sensing unit and transmit a signal indicating an alarm condition; and a control unit comprising a receiver configured to receive said signal on detection of said external force; said sensing unit further comprises a power source and a controller; and a boost module configured to maintain a voltage input from said power source to said controller; wherein said sensing unit and said control unit are wirelessly paired to each other; said control unit is wirelessly networked to an alert device; and said anti-ligature alarm device further comprises a pairing device configured to pair said sensing unit and said control unit.

According to a further aspect of the present invention, there is provided a method of detecting an alarm condition in an anti-ligature alarm device, comprising the steps of: pairing a sensing unit and a control unit by means of a pairing device; providing a voltage input to said sensing unit by means of a power source; maintaining said voltage input from said power source to a controller in said sensing unit by means of a boost module; detecting an external force by means of said sensing unit on application of said external force to said sensing unit; transmitting a signal indicating an alarm condition wirelessly from said sensing unit and receiving said signal by means of said control unit; and transmitting a further signal indicating an alarm condition wirelessly over a network from said control unit to an alert device.

According to a still further aspect of the present invention, there is provided a method of installing an anti-ligature alarm device, comprising the steps of: fitting a sensing unit to a door, said sensing unit being configured to detect an external force when said external force is applied to said sensing unit and transmit a signal indicating an alarm condition; fitting a control unit remote to said door, said control unit comprising a receiver configured to receive said signal on detection of said external force; wirelessly networking said control unit to an alert device; maintaining a voltage input from a power source of said sensing unit to a controller of said sensing unit by means of a boost module; and wirelessly pairing said sensing unit and said control unit, by providing a pairing device comprising a magnet; and pairing said sensing unit and said control unit by bringing said pairing device in contact with said sensing unit, and bringing said pairing device in contact with said control unit.

Embodiments of the invention will be described, by way of example only, with reference to the accompanying drawings. The detailed embodiments show the best mode known to the inventor and provide support for the invention as claimed. However, they are only exemplary and should not be used to interpret or limit the scope of the claims. Their purpose is to provide a teaching to those skilled in the art.

Components and processes distinguished by ordinal phrases such as "first" and "second" do not necessarily define an order or ranking of any sort.

BRIEF DESCRIPTION OF THE SEVERAL VIEWS OF THE DRAWINGS

The invention will now be described by way of example only, with reference to the accompanying drawings, of which.

DETAILED DESCRIPTION OF EMBODIMENTS OF THE INVENTION

FIG. 1

Figure 1:
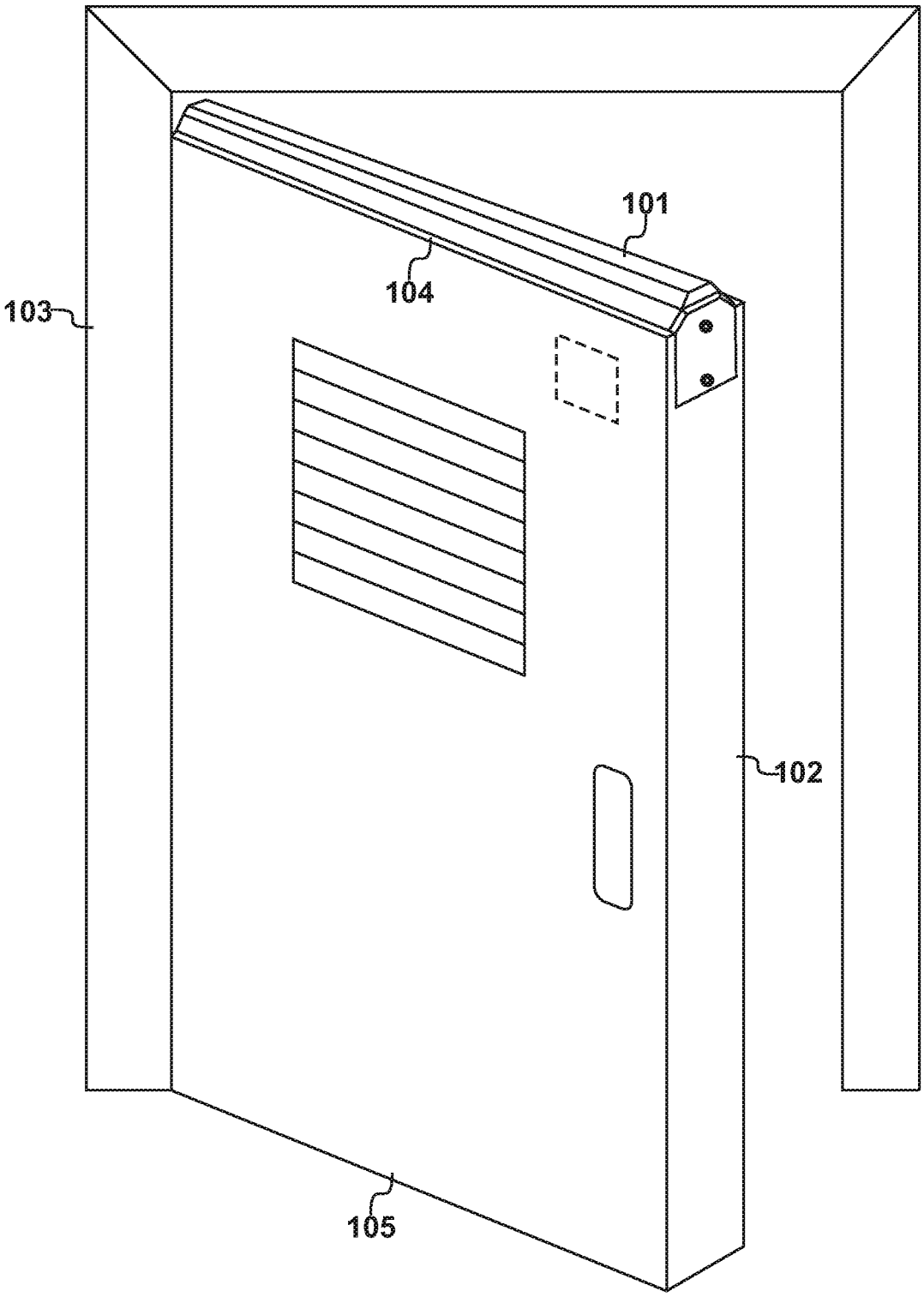
FIG. 1 shows an anti-ligature alarm device.

An anti-ligature alarm device 101 in accordance with the present invention is illustrated in situ in FIG. 1.

Anti-ligature alarm device 101 is shown attached to a door 102 of the type typically found in mental institutions and/or prisons and provides access into and out of facilities such as patient's rooms. Door 102 is hinged to a door frame 103 and is shown in an open position so as to depict anti-ligature alarm device 101 as fitted to a top part of the door.

In the embodiment, anti-ligature alarm device 101 is fitted along an upper edge 104 of door 102, which is a suitable position for prevention of common ligature points. As noted previously, it is common for patients to hang items of clothing or ropes over upper edge 104 to attempt suicide. In alternative embodiments, it is appreciated that anti-ligature alarm device 101 is also suitable for positioning on an alternative part of door 102, for example, anti-ligature alarm device 101 may be suitably fitted onto lower edge 105 in a substantially reverse orientation to that shown. This addresses issues whereby patients position items under the door to create additional tension. It is further appreciated that anti-ligature alarm device 101 can therefore be positioned on any other part of the door as required, such as the side edges or face of the door, and its construction therefore provides the added advantage over conventional door top alarms of not being limited to being positioned on the top of the door only. A further example illustrating an alternative position of the anti-ligature alarm device will be described with respect to FIG. 12.

Figure 9:
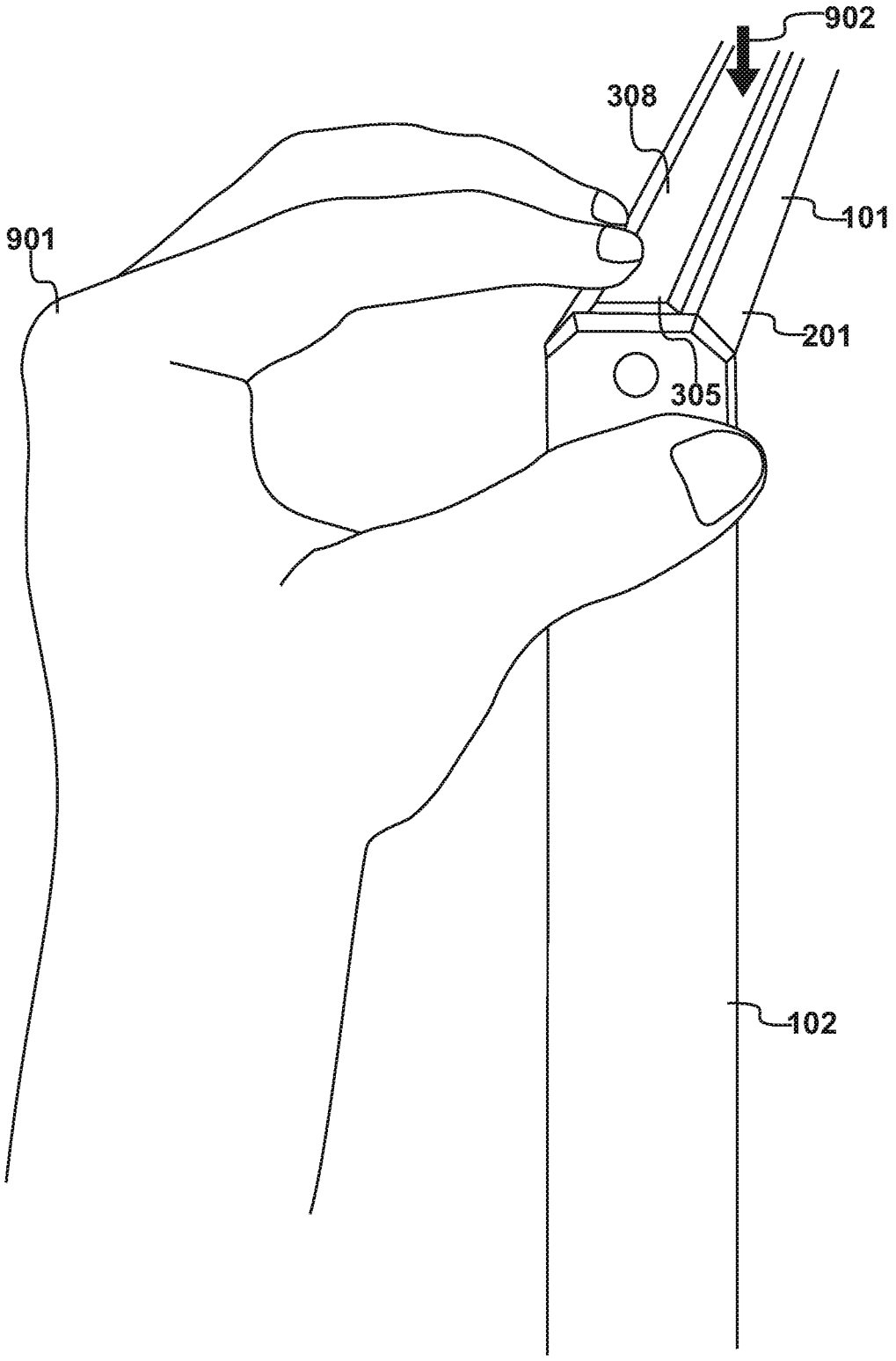
FIG. 9 shows a method of detecting an alarm condition in an anti-ligature alarm device.

In use, as will be explained further with respect to FIG. 9, when a force is applied to anti-ligature alarm device 101, an alarm is activated to notify staff members that an alarm condition has been met. It is therefore appreciated that, when door 102 is in a closed position, sufficient clearance to door frame 103 is provided to avoid false activation without affecting normal use of the door.

FIG. 2

Figure 2:
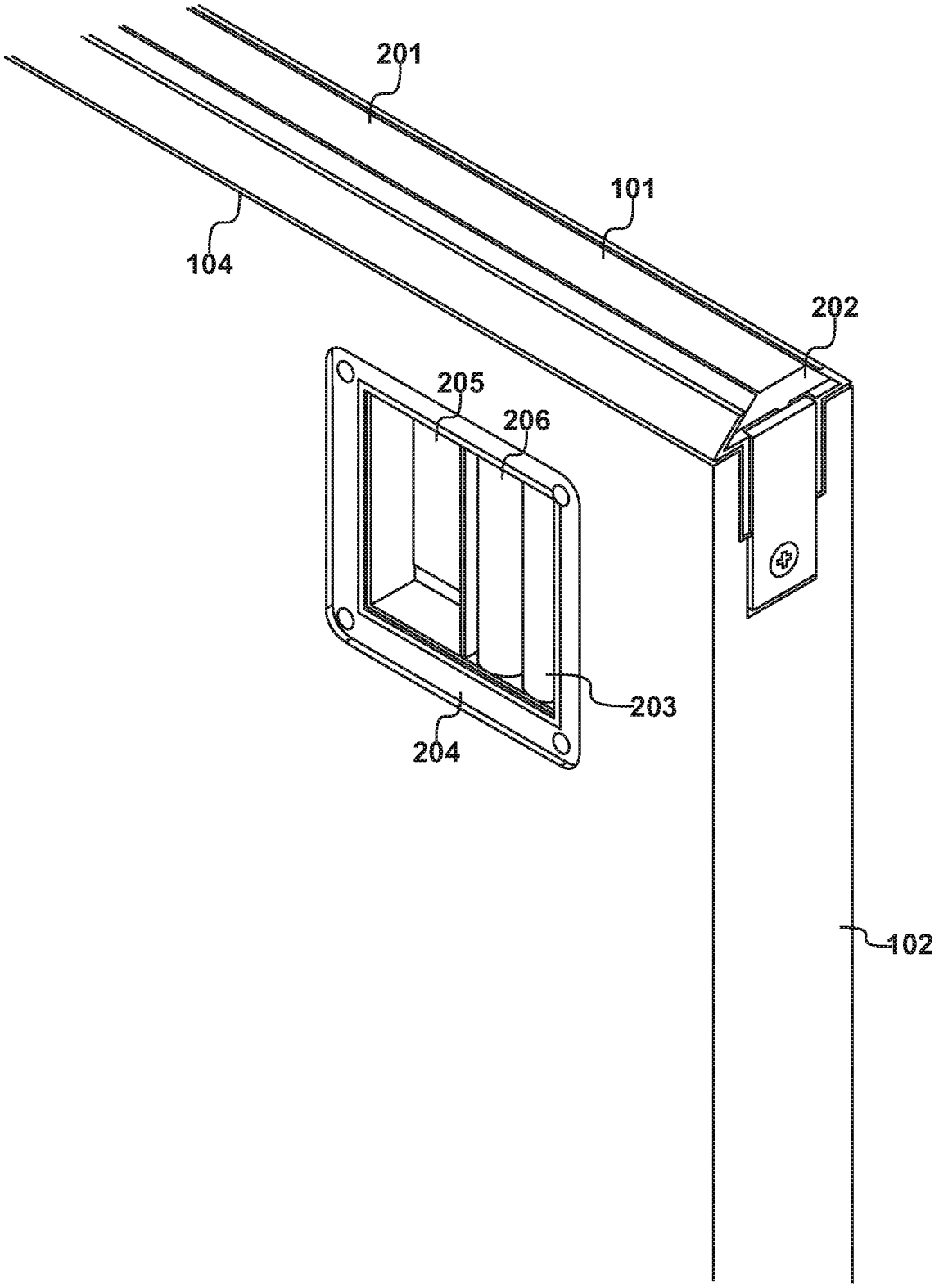
FIG. 2 shows a door having an anti-ligature alarm device fitted.
Figure 6:
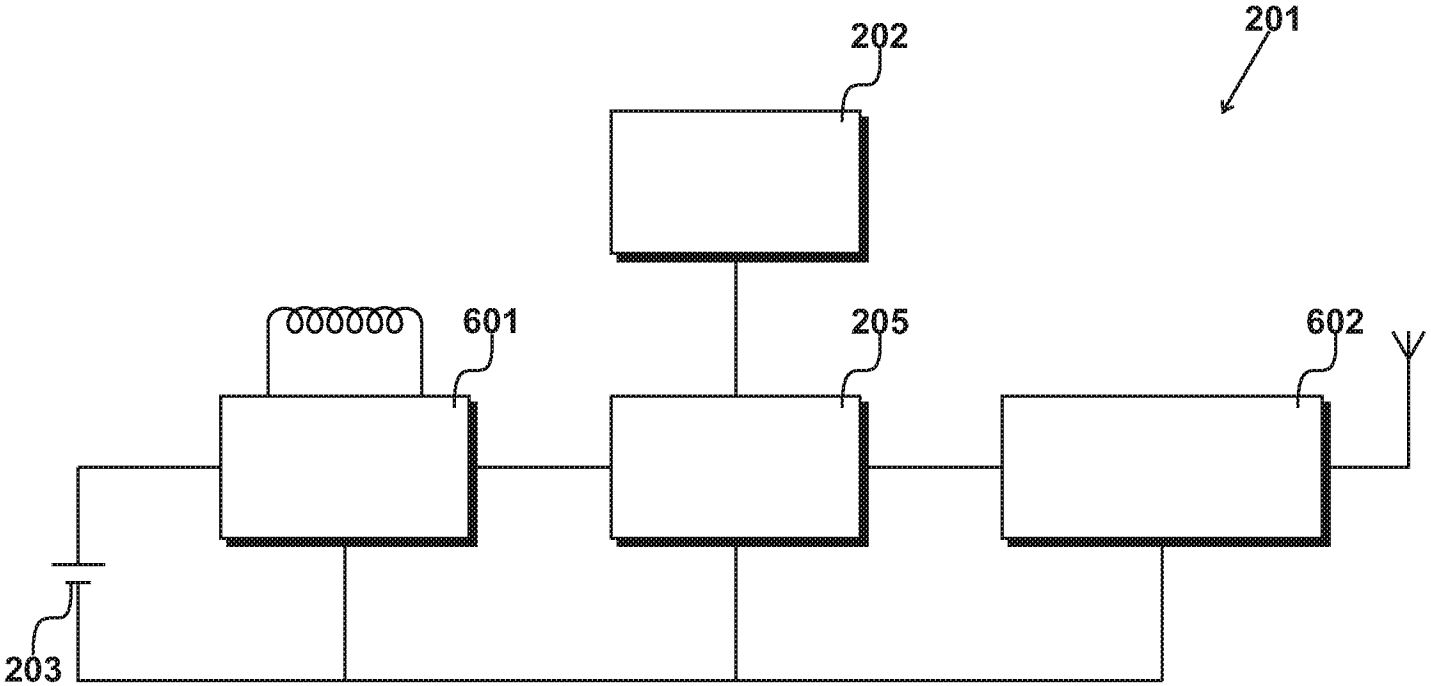
FIG. 6 shows the sensing unit in a simplified block circuit diagram.

A portion of door 102 with anti-ligature alarm device 101 fitted is shown in further detail in respect of FIG. 2. Anti-ligature alarm device 101 comprises a sensing unit 201 which is configured to detect an external force. Sensing unit 201 comprises a sensing portion 202 fitted to upper edge 104 and a power source 203 which is positioned in a housing 204 encased in an upper portion of door 102. Housing 204 is also suitable for housing a controller 205 which provides data from the sensing unit 201 to a control unit and will be described in further detail with respect to FIG. 6.

In the embodiment, power source 203 comprises a plurality of batteries 206. In the embodiment, two batteries are utilized, however, in an alternative embodiment, four batteries are utilized. It is appreciated that any other suitable number of batteries may be used in different embodiments. In an embodiment, each battery is a standard AA single cell dry battery although in alternative embodiments, different battery types may be used. In an embodiment, the batteries are rechargeable.

Housing 204 provides an accessible opening which allows for maintenance of power source 203 and controller 205. In this way, batteries 206 can easily be changed when depleted as part of standard maintenance procedures, and controller 205 repaired as required. In an alternative embodiment, controller 205 is housed in sensing portion 202.

FIG. 3

Figure 3:
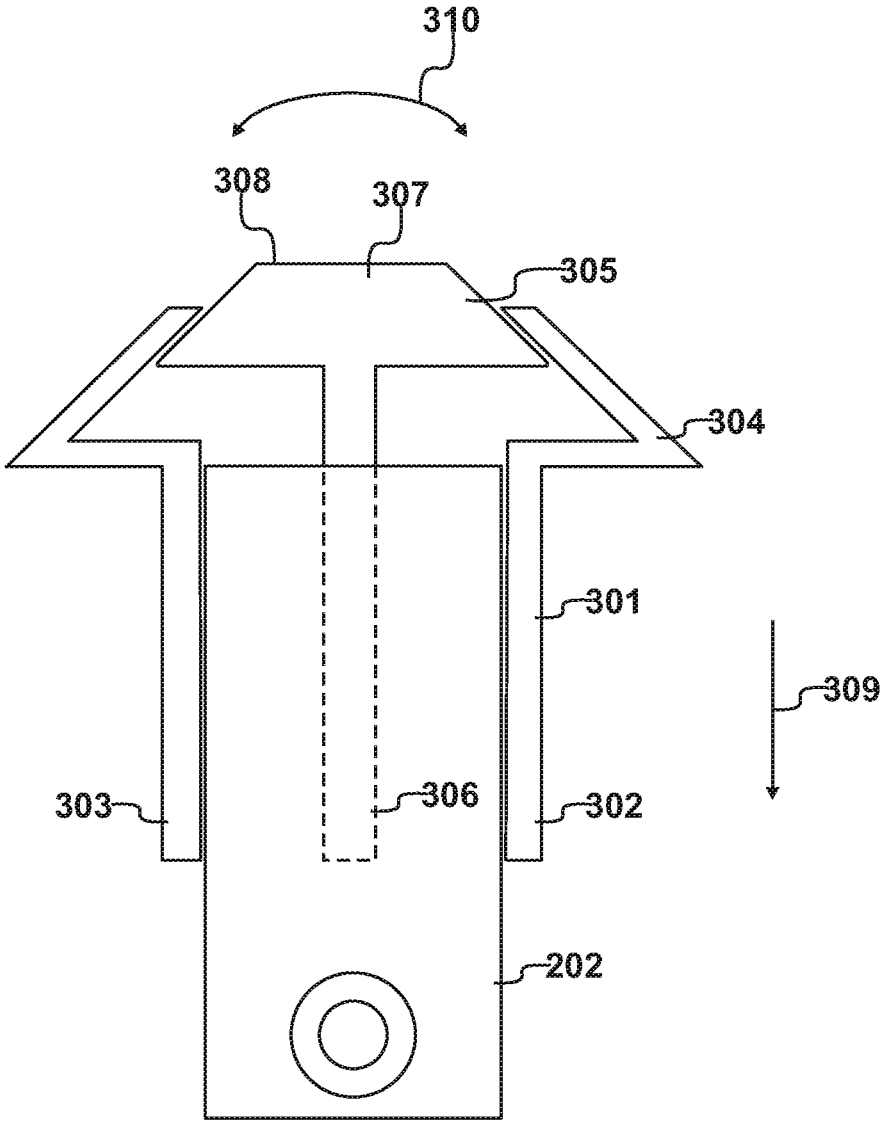
FIG. 3 shows a sensing portion of a sensing unit of an anti-ligature alarm device.

Sensing portion 202 of sensing unit 201 is shown in isolation in a side view in FIG. 3. Sensing portion 202 comprises a support housing 301 having a suitable cross section which corresponds to co-operate with the upper edge of a door. In particular support housing 301 has two support legs 302 and 303 which are able to slot into door 102 and an upper enclosing portion 304 which houses a sprung member 305.

Sprung member 305 comprises a substantially t-shaped cross section having an elongate web 306 and a flange 307. In this embodiment, flange 307 has a trapezium or trapezoid cross section, however, it is appreciated that flange 307 could comprise a rectangular cross section.

Sprung member 305, in use, is configured to move in response to a force applied to a top surface 308 of t-shaped sprung member 305. In the embodiment, in response to an external force, sprung member 305 is able to move in a vertical direction, in the direction of arrow 309, as well as have freedom to roll in accordance with the direction of arrow 310. This will be discussed further with respect to FIG. 5.

FIG. 4

Figure 4:
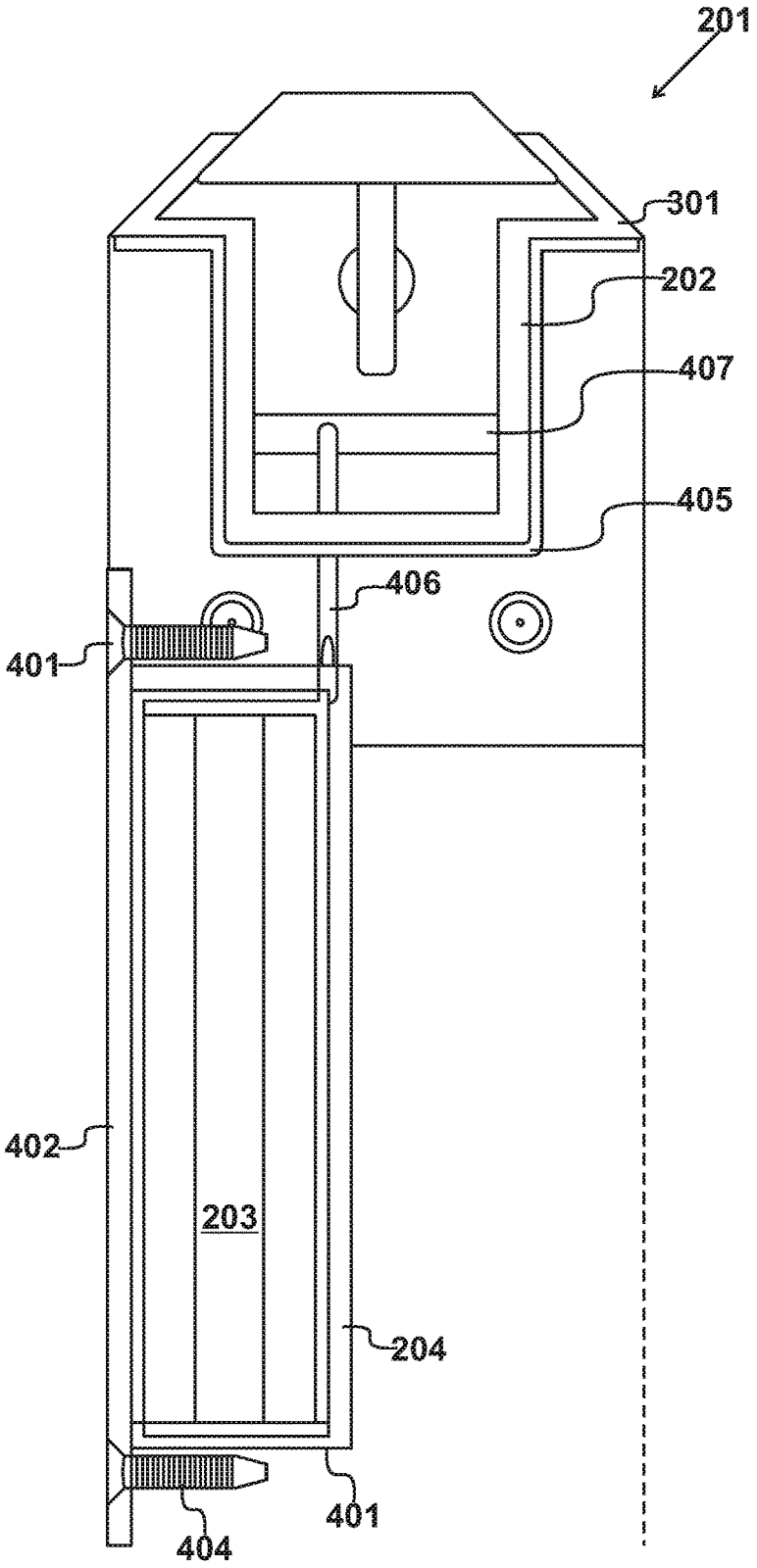
FIG. 4 shows a partial cross-sectional view of a sensing unit.

A partial cross-sectional view of sensing unit 201 is shown in FIG. 4. Housing 204 encases power source 203 as previously described and is positioned in a recess 401 in door 102. To prevent patients from tampering with power source 203, housing 204 includes an external cover 402 which is fastened over housing 204 and into door 102 by means of appropriate fastenings, such as screws 403 and 404.

Sensing portion 202 of sensing unit 201 is positioned in a further recess 405 which resides in the upper edge 104 of door 102.

Power source 203 and controller 205 are connected by means of an electrical connection 406 to sensing portion 202, and in particular, at least one microswitch 407 contained within support housing 301. The arrangement inside support housing 301 will now be further described with respect to FIG. 5.

FIG. 5

Figure 5:
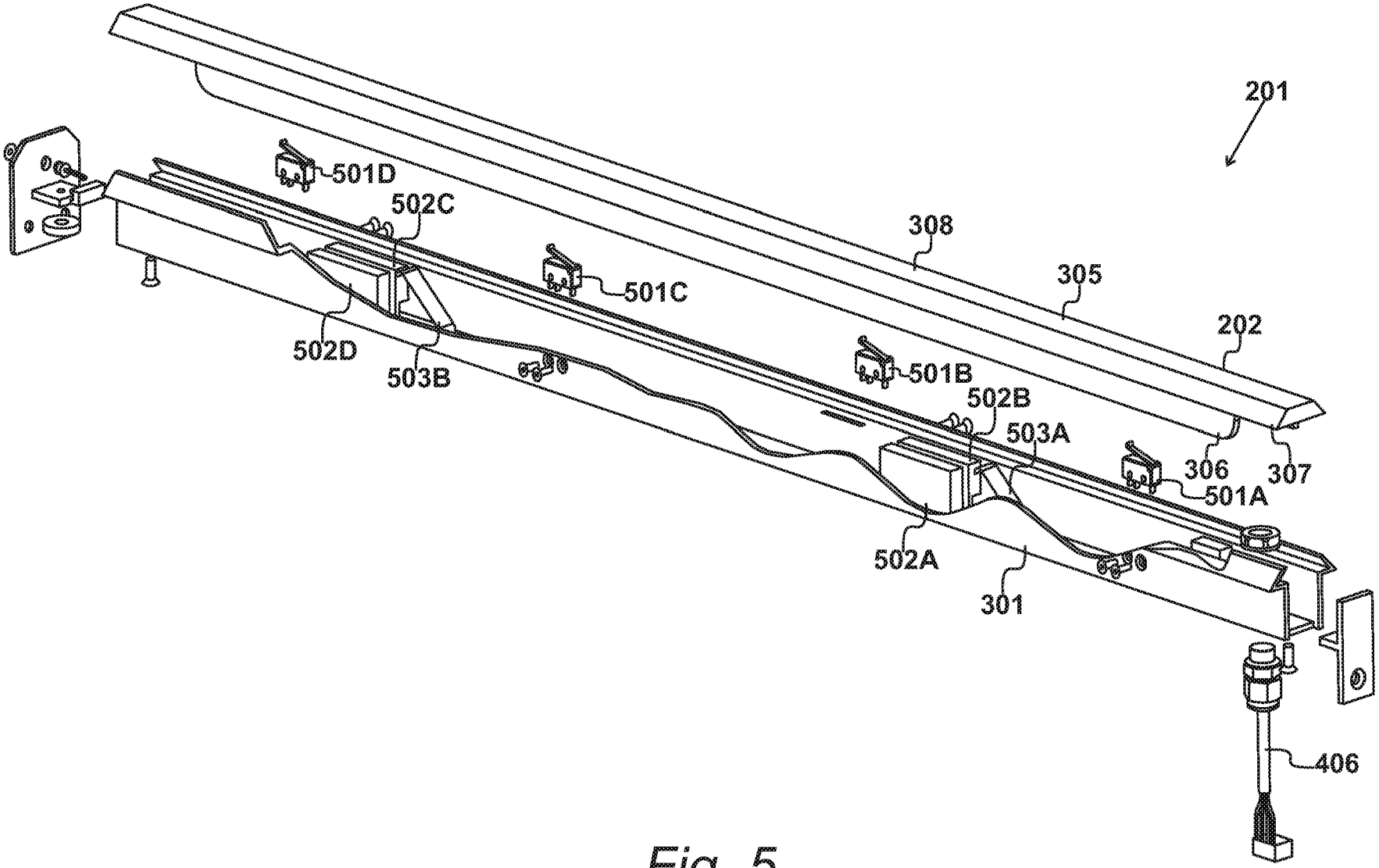
FIG. 5 exploded diagrammatic view of sensing unit of FIGS. 3 and 4.

An exploded diagrammatic view of sensing unit 201 is shown in FIG. 5. Sensing unit 201 is configured to detect an external force when an external force is applied to top surface 308 of sensing portion 202. It is noted that in the exploded view, the side walls of support housing 301 are partially cut away to illustrate the positioning of components inside the support housing.

Sensing unit 201 comprises at least one microswitch, and, in this embodiment, comprises four microswitches 501. In use, each of the four microswitches are positioned at suitable points along the length of support housing 301. It is appreciated that the number of microswitches utilized may vary depending on the requirements of the embodiment and may include any number of microswitches other than four. In the embodiment, microswitches 501 are sealed microswitches which provides them with a degree of moisture resistance. This is advantageous as the anti-ligature alarm device can therefore be utilized on doors for bathrooms as well as standard rooms.

A plurality of guides 502 are incorporated into support housing 301 at suitable intervals along the length of support housing to provide a support and guide for sprung member 305. Two springs 503 are also included which provide a sprung bias to sprung member 305 when in use. Thus, sprung member 305 is biased in a direction away from microswitches 501. In use, therefore, elongate web 306 of sprung member 305 is positioned between guides 502 and flange 307 rests against part of springs 503.

Guides 502 are configured to hold elongate web 306 in place even when an external force is applied. Guide 502 however permit sprung member 305 to roll in the direction of arrow 310 of FIG. 3. This means that an alarm condition may still be activated when the force on the door includes more than one vector component or is applied at an angle other than ninety degrees to the top surface.

In use, when a force is applied to top surface 308, contact is made with springs 503 which triggers at least one of the microswitches 501. When the microswitches are triggered, the electrical connection via electrical connection 406 breaks and controller 205 registers a loss of communication. This indicates an alarm condition as further described in FIGS. 9 to 11.

FIG. 6

As previously described, sensing unit 201 is configured to detect and external force when the external force is applied to the sensing unit and, following this, transmit a signal indicating an alarm condition to a control unit. Sensing unit 201 is shown in the form of a simplified block circuit diagram in FIG. 6.

Sensing unit 201 comprises sensing portion 202, power source 203 and controller 205. Sensing unit 201 further comprises a boost module 601 and a wireless transmitter 602.

Sensing portion 202 provides a sensor which provides an indication to controller 205 as to whether an alarm condition has been met. In this case, the alarm condition is met when an external force is applied to the sensing portion 202. Controller 205 is therefore configured to receive a signal which can be appropriately transmitted to a control unit (as will be described further with respect to FIG. 7) by means of wireless transmitter 602. In the embodiment, controller 205 is a microcontroller.

Boost module 601 is configured to maintain a voltage input from power source 203 to controller 205. The inclusion of boost module permits the circuit shown in FIG. 6 to operate at a relatively low voltage in comparison to a circuit without such a boost module.

In use, a voltage is provided from power source 203. In an embodiment, two AA batteries are utilized as power source 203 and these provide three volts (3 v) of voltage to the circuit. Boost module 601 is configured to maintain the circuit to the controller 205 at a constant three volts (3 v) such that controller 205 receives an input voltage of substantially three volts (3 v). In conventional systems, if the batteries become depleted, controller 205 will cease to function resulting in an alarm condition. However, the inclusion of boost module 601 means that, if the batteries deplete to, for example, two and a half volts (2.5 v), the boost module 601 is able to maintain the input voltage into controller 205 at a steady three volts (3 v) such that controller 205 can continue operating for an increased period of time.

Thus, the inclusion of boost module 601 allows the circuit to function for a longer time period, meaning that power source 203 does not need to be replaced frequently. It is anticipated that, in the current embodiment, suitable batteries would need replacing once a year which is convenient in terms of standard maintenance procedures.

Furthermore, boost module 601 maintains the brightness of the visual indicator on sensing unit 201, whose function will be described further in respect of FIG. 8.

In the embodiment, controller 205 further comprises a debounce circuit, the functioning of which will be described further with respect to FIG. 10.

In accordance with the invention, sensing unit 201 is wirelessly paired to a control unit, which will now be described with respect to FIG. 7.

FIG. 7

Figure 7:
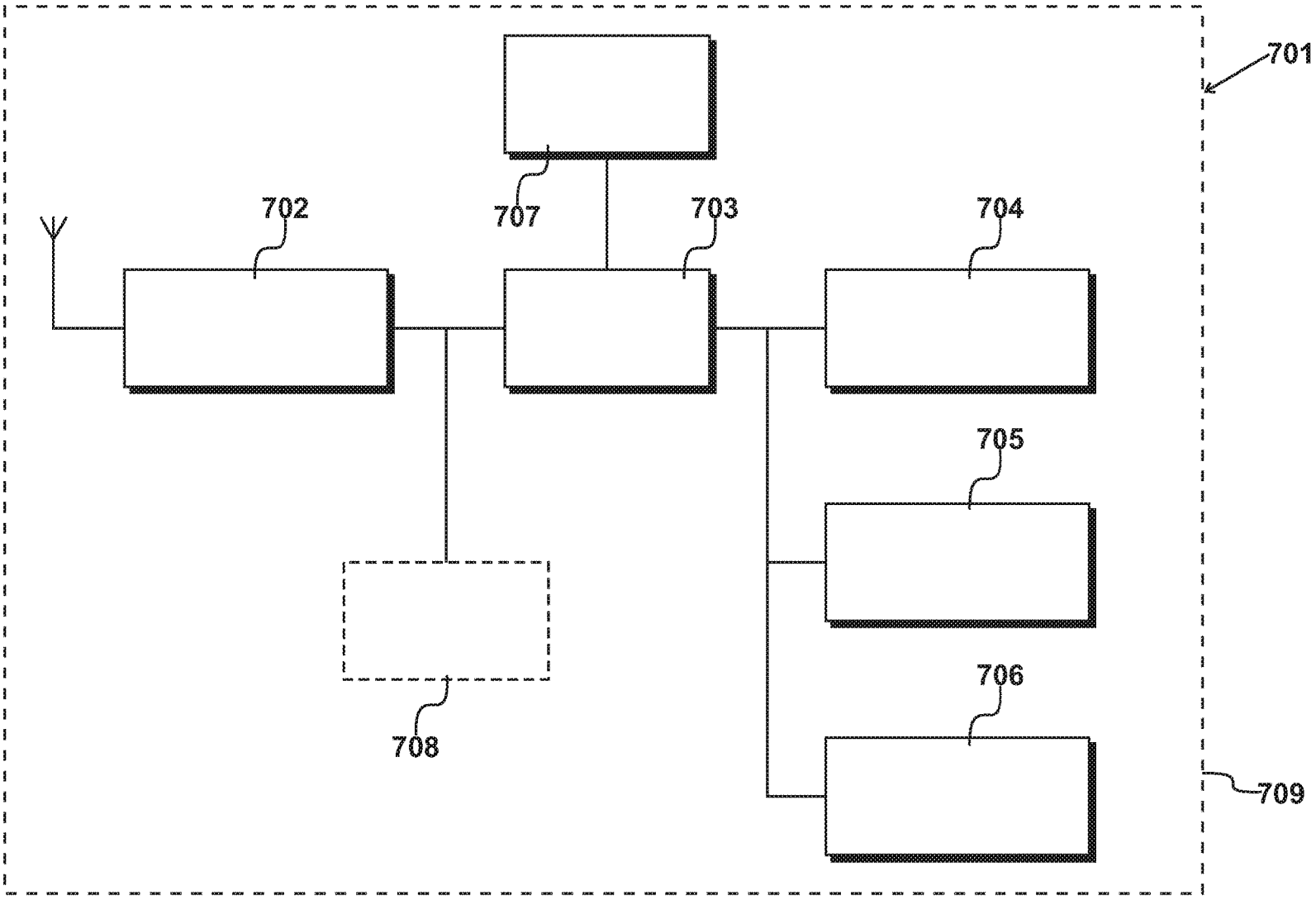
FIG. 7 shows a control unit in block diagrammatic form.

Control unit 701, which is wirelessly paired to sensing unit 201 previously described, is illustrated in respect to FIG. 7 in block diagrammatic form. Control unit 701 is typically positioned remotely to sensing unit 201 and door 102. For example, while door 102 provides an entrance to a patient's room, control unit 701 may be positioned in a loft space or a space some distance away from the room itself. In an embodiment, control unit 701 and sensing unit 201 are positioned between zero and ten meters (0-10 m) away from each other, and in a further embodiment, the distance is between five and six meters (5-6 m). In a still further embodiment, the distance is between seven and eight meters (7-8 m).

Control unit 701 comprises a receiver 702 configured to receive a signal from sensing unit 201 when a force is detected. In the embodiment, receiver 702 is a wireless receiver so as to enable wireless data to be received to control unit 701.

Control unit 701 further comprises a controller 703 which may be a similar micro controller to controller 205 in sensing unit 201. Controller 703 is connected to a visual indicator 704, an audible indicator 705 and relay 706. Thus, in the event of an alarm condition, controller 703 is able to provide a visual indication of the alarm condition by means of visual indicator 704 or an audible indication of the alarm condition by means of audible indicator 705. In the embodiment, relay 706 is a solid-state relay which provides output of control unit 701, and is configured to open so as to alert staff of an alarm condition.

Control unit 701 further comprises a sensor 707 which is enabled to pair control unit 701 with a corresponding sensing unit 202 as will be described further with respect to FIG. 8.

In an embodiment, control unit 701 further includes an additional module 708 which can provide further functionality to control unit 701. Module 708 may be a suitable printed circuit board (PCB) which is further incorporated into control unit 701 so as to allow extra features in the system. In an embodiment, module 708 comprises a communication module comprising a transmitter configured to transmit a signal in an alarm condition to an electronic device. The electronic device may comprise a mobile telephone including software which allows a member of staff to be notified of the alarm condition or any other data. This may allow quicker responses to severe situations involving patients.

In a further embodiment, module 708 comprises an ethernet module which enables connection to a local area network. Data can therefore be transmitted into cloud storage or another network system to enable operatives or staff members to view the data on another device, such as an electronic device, for example, a mobile telephone, desktop computer, tablet computer or other device. This further enables a system to be created which allows for several rooms to be monitored at once.

In an embodiment, therefore, module 708 comprises an expansion module which enables any of the above options to be added once control unit 701 has been installed. This enables various connectivity possibilities to be added depending on user requirements and allows for upgrades to be made as a customer's circumstances change or develop.

Control unit 701 also comprises an external casing 709 which is configured to contain the components described herein. External casing 709 may take the form of a standard electronic box which is suitable for holding printed circuit boards and other electronic components.

FIG. 8

Figure 8:
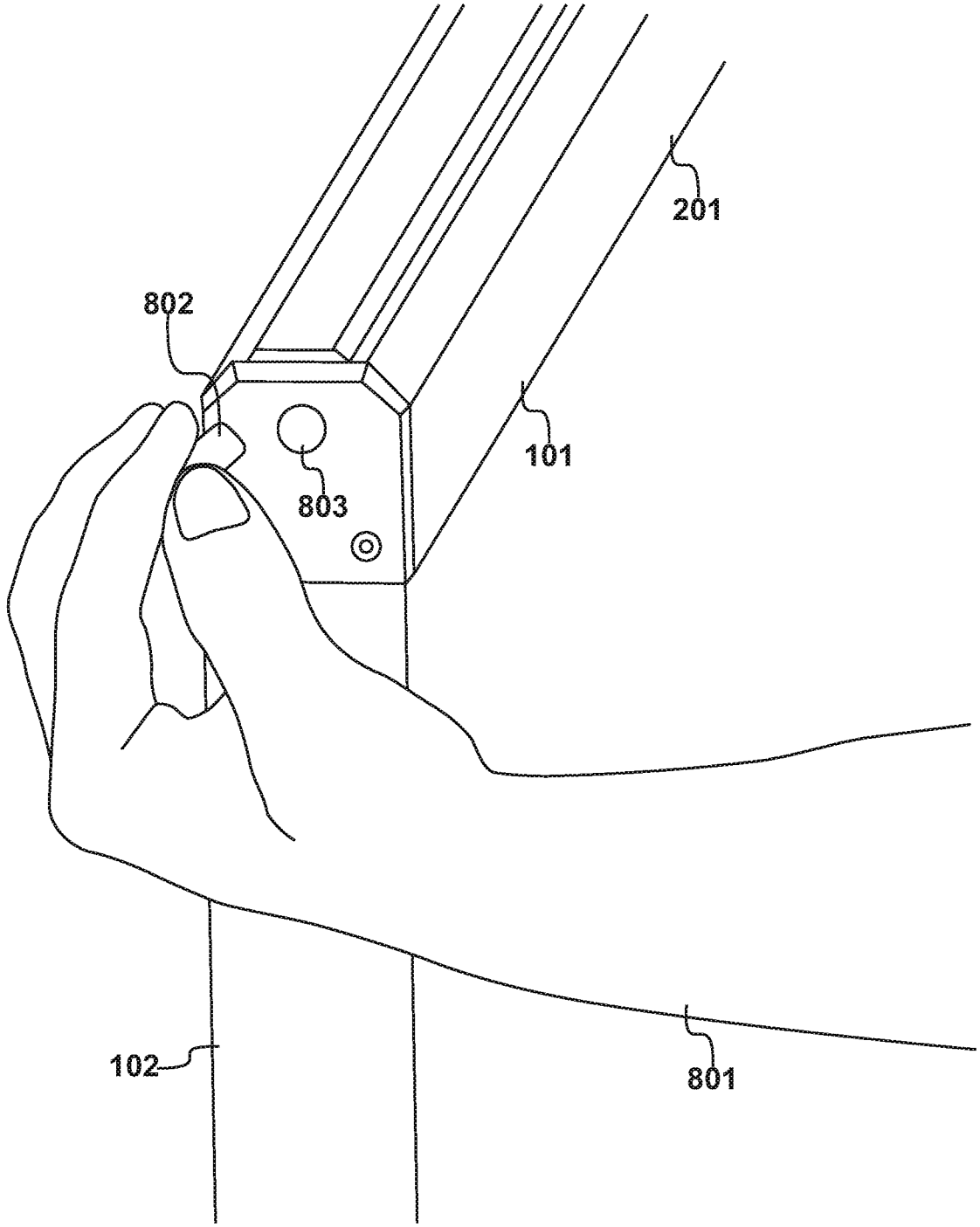
FIG. 8 shows a partial view of a door including an anti-ligature alarm device.

A partial view of door 102 including anti-ligature alarm device 101 is shown in FIG. 8. FIG. 8 illustrates a method of installing anti-ligature alarm device 101 and wirelessly pairing sensing unit 201 and control unit 701 to allow for communication between the two.

In this illustrated embodiment, sensing unit 201 has been fitted to door 102 and control unit 701 as previously described has been fitted remote to door 102 with receiver 702 being so positioned to enable receipt of a signal when an external force is detected by sensing unit 201.

Operative 801 has been provided with a pairing device 802 which is configured to wirelessly pair sensing unit 201 with control unit 701.

Pairing device 802 comprises a magnet which may be incorporated into a portable device such as a key fob, keyring or similar. This enables operative 801 to carry around pairing device for use when required. Pairing device 802 serves the purpose of not only allowing for the wireless pairing of control unit 701 with sensing unit 201, but also allows operative 801 to test that the system is operating effectively at regular intervals.

Sensing unit 201 comprises a visual indicator 803, which, in the embodiment, comprises a color-changing LED. Color-changing LED is configured to show different colors depending on the current status of the sensing unit. Pairing device 802 is therefore configured to activate a visual indicator on sensing unit 201. For example, if pairing has been successfully completed, by bringing pairing device 802 into contact with sensing unit 201 in the manner shown in FIG. 8, visual indicator 803 can produce a green light such that operative 801 can identify that the system is operating correctly.

If the pairing device 802 is continuously held in contact with sensing unit 201, visual indicator 803 will turn amber to indicate an alert condition, and then red to activate the alarm in control unit 701. In this way, anti-ligature alarm device 101 can be appropriately tested to ensure that the connection between control unit 701 and sensing unit 201 is still in force, and the activation of an alarm condition is still functioning. Thus, pairing device 802 is able to test the operation of anti-ligature alarm device 101.

In order to pair sensing unit 201 with control unit 701, pairing device 802 is brought into contact with sensing unit 201 in a substantially similar manner. In addition, pairing device 802 is also brought into contact with control unit 701, or external casing 709 thereof to initiate the connection between the two. Visual indicator 704 on control unit 701 may also comprise an LED which is configured to provide an illumination depending on the status of the control unit. In normal use, visual indicator 704 is typically illuminated to confirm that control unit 701 is receiving a signal from sensing unit 201 and will further provide a different illumination if there is no signal after a predetermined period of time. If this is the case, an alarm condition will be indicated to alert an operative that the system is not functioning correctly.

Once paired therefore, sensing unit 201 and control unit 701 are each configured to transmit and/or receive wireless signals across a range of between zero and ten meters (0-10 m). It is anticipated that, sensing unit 201 and control unit 701 may be paired prior to fitting to a door in an institution. In particular, sensing unit 201 and control unit 701 may be supplied to a customer pre-paired and ready to be fit to an existing door as required. Alternatively, the pairing process can be completed once sensing unit 201 and control unit 701 are positioned in place.

It is noted that, in normal use, visual indicator 803 on sensing unit 201 does not provide any illumination. In this way, a patient has no indication that the anti-ligature alarm device is operating and is unlikely to create false alarms by attempting to activate the visual indicator.

FIG. 9

A method of detecting an alarm condition in anti-ligature alarm device 101 will now be described with respect to FIGS. 9 and 10. Anti-ligature alarm device 101 is shown fitted to door 102 and sensing unit 201 has been wirelessly paired to control unit 701.

An alarm condition is detected when an external force is applied to sensing unit 201. In FIG. 9, an operative 901 is shown applying an external force to top surface 308 which would be illustrative of an alarm condition. In particular, this simulates the kind of external force applied by a patient of similar when using an object to provide a ligature point in combination with door 102.

Anti-ligature alarm device 101 is in operating mode whereby it is able to transmit signals from the sensing unit 201 to the control unit 701. In this operating mode, a voltage input is provided to sensing unit 201 by means of power source 203, such as batteries 206. Boost module 601 maintains the voltage input between the power source 203 and controller 205 thereby ensuring that anti-ligature alarm device 101 remains operative and in the operating mode without losing effectiveness.

When an external force, indicated by arrow 902, is applied by operative 901 to top surface 308 of sprung member 305, sensing unit 201 detects external force 902 by sprung member 305 making contact with springs 503 thereby activating at least one of the microswitches 501. Controller 205 therefore registers a loss of communication and transmits a signal indicating an alarm condition from sensing unit 201 whereby control unit 701 receives the signal indicating an alarm condition by means of receiver 702.

Further, on receipt of the signal indicating an alarm condition, relay 706 is activated by controller 703 thereby leading relay 706 to provide an alert by means of an appropriate warning device. In this respect, warning device includes providing a visual illumination by means of the visual indicator 704 and/or providing an audible alarm by means of audible indicator 705. Alternatively, relay 706 may instruct controller 703 to provide an alert by means of a local area network or ethernet module or transmit a signal to an appropriate electronic device.

FIG. 10

Figure 10:
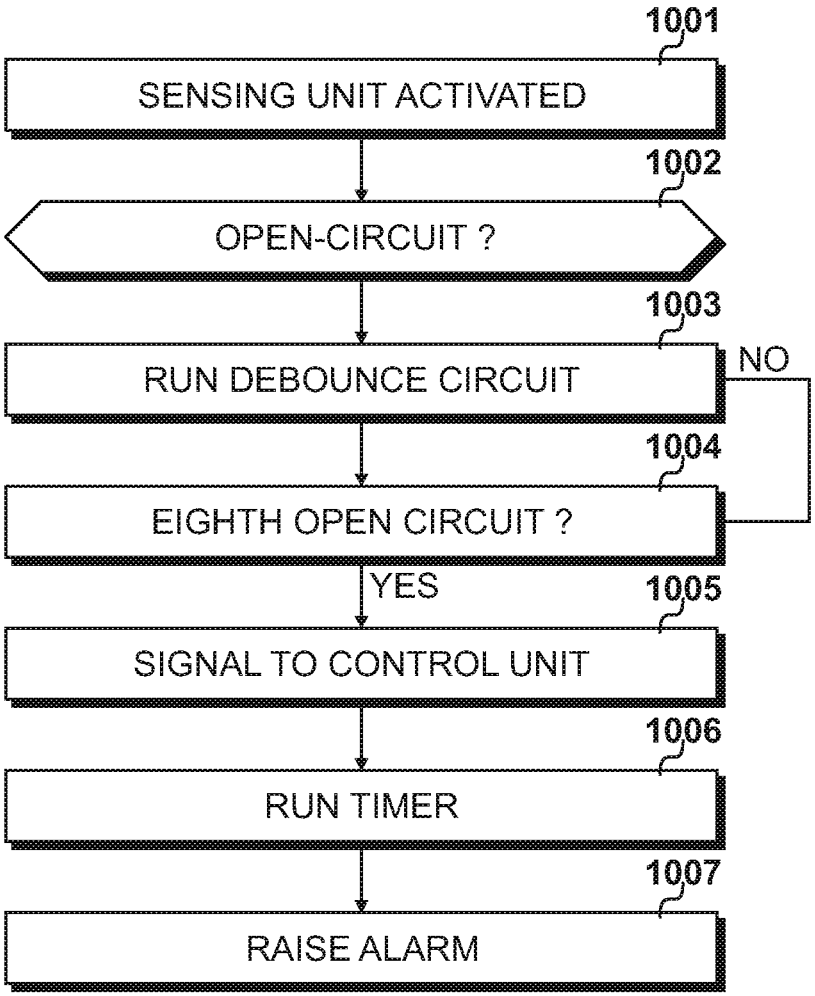
FIG. 10 shows a flow chart illustrating further steps in the method of detecting an alarm condition in an anti-ligature alarm device.

Further steps in the method of detecting an alarm condition in anti-ligature alarm device 101 are described in the flow chart of FIG. 10.

Sensing unit 201 is configured to monitor sensing portion 202 for signals indicating that an external force has been applied to sensing portion 202. In the embodiment, controller 205 reviews sensing portion 202 every ten milliseconds (10 ms) to assess whether the electronic circuit is considered open or closed. An indication that the circuit is open is consistent with an alarm condition and at step 1001 the sensing unit 201 is activated. At step 1002, the controller checks that the circuit is open or not, and if the circuit is considered open, then the signal is processed through a debounce circuit at step 1003. If the circuit is considered a closed-circuit, controller 205 returns to monitoring the sensing portion 202 to assess whether the circuit is open or closed.

The debounce circuit in controller 205 is configured to monitor for any false alarms and provide an error correction process. For example, in institutions or hospitals, it is possible to experience interference from electronic devices such as mobile telephones or similar. The debounce circuit therefore monitors for a predetermined number of open circuit signals. In the embodiment, once eight consecutive open circuit signals have been received at step 1004, at step 1005 an appropriate signal indicating an alarm condition is transmitted to control unit 701 by transmitter 602.

On receipt of the signal by control unit 701, controller 703, which further comprises a timer, activates the timer at step 1006. In the embodiment, the timer is set to provide an alarm at appropriate intervals depending on requirements. For example, the timer may be set to activate the relay after twenty seconds, at which point, at step 1007, an alarm is raised and relay 706 activates audible indicator 705 and/or visual indicator 704. As previously indicated, the process of raising an alarm may also be involve transmitting a signal to a local area network or a staff member's mobile telephone or other electronic device. It is appreciated that the control unit can be set in alternative embodiments to provide appropriate alarms after the expiry of any suitable time period.

Anti-ligature alarm device 101 is also able to raise an alarm in the event of an error or the absence of a transmitted signal at any of the aforementioned steps. Consequently, each signal transmitted includes a checksum to ensure that the signal received or transmitted is correct and not a fault in the system. The error correction procedure utilizes a Hamming code such that each set of bits includes a parity bit. Thus, the procedure monitors if the preceding data was odd or even. In the embodiment, if a number is received which is odd rather than even, the data is encoded as a parity error and consequently is corrected. If the error cannot be connected, and error condition is noted and a signal is provided to indicate an alarm condition due to the error.

FIG. 11

Figure 11:
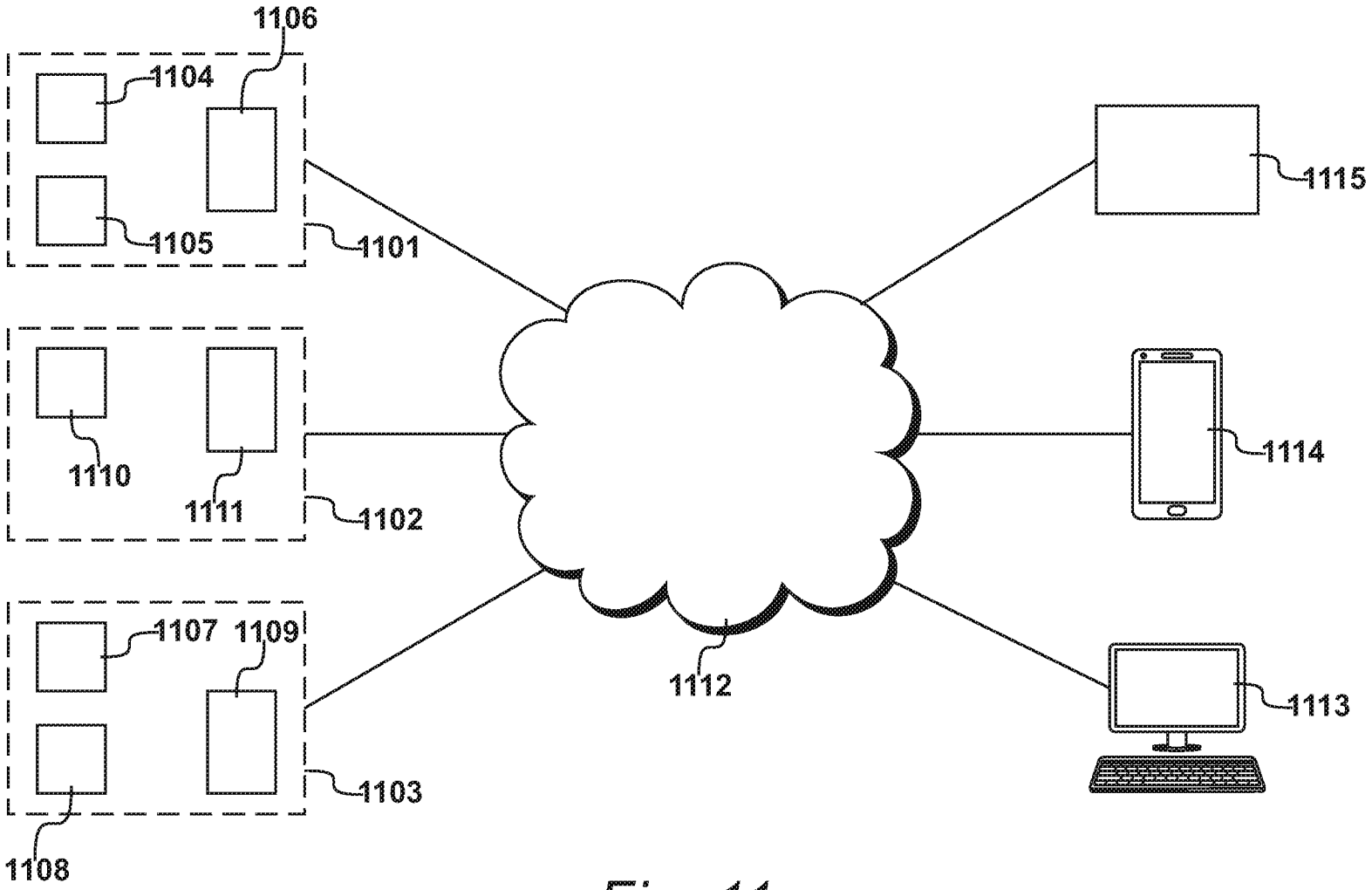
FIG. 11 shows an example network utilizing a plurality of anti-ligature alarm devices.

An example network utilizing a plurality of anti-ligature alarm devices substantially similar to anti-ligature alarm device 101 is shown in FIG. 11.

Anti-ligature alarm devices 1101, 1102 and 1103 are provided. In the embodiment, anti-ligature alarm device 1101 and anti-ligature alarm device 1103 are substantially similar and comprise a plurality of sensing units and a single control unit. For example, anti-ligature alarm device 1101 comprises sensing units 1104 and 1105 which are wirelessly paired to single control unit 1106. Similarly, anti-ligature alarm device 1103 comprises sensing units 1107 and 1108 which are wirelessly paired to single control unit 1109. In this way, anti-ligature alarm device 1101 and 1103 represent an example whereby two doors in one room are each fitted with a sensing unit, and a single control unit is utilized which provides an alarm condition in relation to the room or patient. An example would be a room having an en-suite facility and a sensing unit being fitted to both the en-suite door and the main door into the room. Thus, in these embodiments, the two sensing units are configured to operate at similar frequencies to enable them to be controlled by a single control unit. It is appreciated that, in alternative embodiments, a higher plurality of sensing units per control unit may be utilized.

Anti-ligature alarm device 1102, in contrast, utilizes a single sensing unit 1110 and a single control unit 1111 as previously described.

In the embodiment, each anti-ligature alarm device can be wirelessly networked to an alert device which provides an alert to an appropriate staff member. As shown, each anti-ligature alarm device 1101, 1102, 1103 is connected wirelessly to a network 1112 which is able to transmit appropriate signals to an alert device, for example, to a local intranet by means of desktop computers, such as desktop computer 1113, electronic devices such as mobile telephone 1114 and central alarm 1115.

Thus, when an alarm condition is indicated, a signal can be sent across network 1112 and alert an individual staff member via electronic device 1114.

In an embodiment, a signal transmitted over network 1112 can also be incorporated into central alarm 1115. Central alarm 1115 may already be present in the hospital or institution and provide an alert system including input devices such as buttons placed in such buildings, in the event that a staff member requires assistance. In this example, anti-ligature alarm devices of those herein described can therefore be incorporated into these existing systems to utilize the central alarms provided to the throughout these buildings.

FIG. 12

Figure 12:
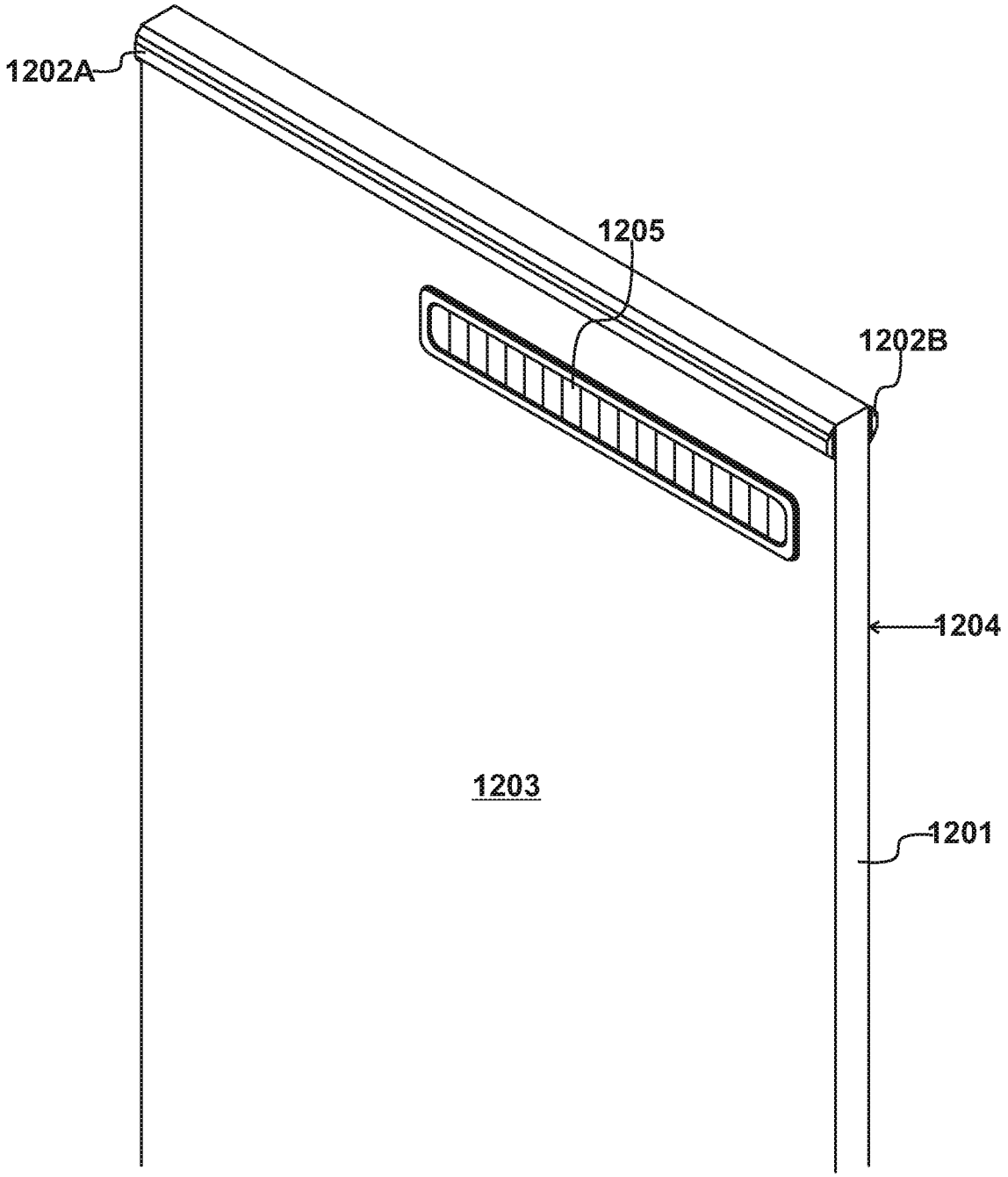
FIG. 12 shows an alternative embodiment of a door having an anti-ligature alarm device fitted thereto.

FIG. 12 shows an alternative embodiment of a portion of a door having an anti-ligature alarm device fitted thereto.

In the embodiment, door 1201 includes a plurality of anti-ligature alarm devices 1202. Anti-ligature alarm devices 1202 are each substantially similar to anti-ligature alarm device 101 as herein described and function in a substantially similar manner. However, in this particular embodiment, anti-ligature alarm device 1202A is fitted to a front surface 1203 of door 1201 and anti-ligature alarm device 1202B is fitted to a rear surface 1204 of door 1201. Thus, this embodiment illustrates the flexibility of the anti-ligature alarm device of the present invention, in that it is suitable for mounting to any suitable part of a door.

While in the embodiment, a plurality of anti-ligature alarm device 1202 are shown, it is appreciated that, in an alternative embodiment, a single one of the anti-ligature alarm devices may be provided. For example, in one embodiment, door 1201 is provided with anti-ligature alarm device 1202A only. In a further embodiment, door 1201 is provided with anti-ligature alarm device 1202B but not anti-ligature alarm device 1202A.

The embodiment of FIG. 12 illustrates a further alternative to the arrangement of anti-ligature alarm device 101. In this embodiment, the power source needed to power anti-ligature alarm device 1202 is provided by power source 1205. In the embodiment, power source 1205 comprises a solar cell or panel fitted to door 1201. Thus, in this way solar panel is able to provide power to the sensing unit of the anti-ligature alarm device. In an embodiment, the solar panel may be utilized with corresponding batteries.

It is appreciated that the solar cell of FIG. 12 is also suitable for use in the embodiment of FIG. 2 as an alternative to batteries 203. It is further appreciated that other power sources may be utilized to provide power to an anti-ligature alarm device in accordance with the present invention.

The invention claimed is:

1. An anti-ligature alarm device, comprising:

a sensing unit configured to detect an external force when said external force is applied to said sensing unit and transmit a signal indicating an alarm condition; and a control unit comprising a receiver configured to receive said signal on detection of said external force;

said sensing unit further comprises a power source and a controller; and a boost module configured to maintain a voltage input from said power source to said controller; wherein said sensing unit and said control unit are wirelessly paired to each other;

said control unit is wirelessly networked to an alert device; and said anti-ligature alarm device further comprises a pairing device configured to pair said sensing unit and said control unit.

2. An anti-ligature alarm device according to claim 1, wherein said sensing unit further comprises a debounce circuit.

3. An anti-ligature alarm device according to claim 1, wherein said sensing unit comprises at least one microswitch.

4. An anti-ligature alarm device according to claim 3, wherein said at least one microswitch is sealed so as to provide moisture resistance.

5. An anti-ligature alarm device according to claim 1, wherein said sensing unit comprises a sprung member.

6. An anti-ligature alarm device according to claim 5, wherein said sprung member comprises a substantially t-shaped cross-section.

7. An anti-ligature alarm device according to claim 5, wherein said sprung member is configured to roll in response to said external force.

8. An anti-ligature alarm device according to claim 1, wherein said pairing device is configured to activate a visual indicator on said sensing unit.

9. An anti-ligature alarm device according to claim 1, wherein said sensing unit and said control unit are each configured to transmit and/or receive wireless signals across a range of between 0 and 10 metres.

10. An anti-ligature alarm device according to claim 1, further comprising a plurality of sensing units wirelessly paired with a single control unit.

11. An anti-ligature alarm device according to claim 1, wherein said alert device comprises any one of the following:

a central alarm; an electronic device; a desktop computer.

12. An anti-ligature alarm device according to claim 1, wherein said alert device is an electronic device and said control unit comprises a transmitter configured to transmit a signal in said alarm condition to said electronic device.

13. An anti-ligature alarm system comprising a plurality of anti-ligature alarm devices according to claim 1, wherein said alert device is a central alarm and each said control unit of each anti-ligature alarm device is networked to said central alarm.

14. A method of detecting an alarm condition in an anti-ligature alarm device, comprising the steps of:

pairing a sensing unit and a control unit by means of a pairing device;

providing a voltage input to said sensing unit by means of a power source;

maintaining said voltage input from said power source to a controller in said sensing unit by means of a boost module;

detecting an external force by means of said sensing unit on application of said external force to said sensing unit;

transmitting a signal indicating an alarm condition wirelessly from said sensing unit and receiving said signal by means of said control unit; and transmitting a further signal indicating an alarm condition wirelessly over a network from said control unit to an alert device.

15. A method of detecting an alarm condition according to claim 14, wherein said sensing unit comprises a sprung member and at least one microswitch, said method further comprising the step of:

applying said external force to said sprung member; and activating said at least one microswitch so as to transmit said signal indicating an alarm condition.

16. A method of detecting an alarm condition according to claim 14, wherein said control unit comprises a relay and further comprising the steps of:

activating said relay on receipt of said signal by said control unit; and providing an alert by means of said alert device.

17. A method of installing an anti-ligature alarm device, comprising the steps of:

fitting a sensing unit to a door, said sensing unit being configured to detect an external force when said external force is applied to said sensing unit and transmit a signal indicating an alarm condition;

fitting a control unit remote to said door, said control unit comprising a receiver configured to receive said signal on detection of said external force;

wirelessly networking said control unit to an alert device;

maintaining a voltage input from a power source of said sensing unit to a controller of said sensing unit by means of a boost module; and wirelessly pairing said sensing unit and said control unit, by providing a pairing device comprising a magnet; and pairing said sensing unit and said control unit by bringing said pairing device in contact with said sensing unit, and bringing said pairing device in contact with said control unit.

18. A method of installing an anti-ligature alarm device according to claim 17, further comprising the step of:

testing the operation of said anti-ligature alarm device by means of said pairing device.

19. A method of installing an anti-ligature alarm device according to claim 18, wherein said step of testing comprises:

bringing said pairing device into contact with said sensing unit; and providing a visual indicator on said sensing unit.

* * * * *